United States Patent [19]

Cook, Jr. et al.

[11] 4,116,276

[45] Sep. 26, 1978

[54] METHOD FOR INCREASING THE RECOVERY OF NATURAL GAS FROM A GEO-PRESSURED AQUIFER

[75] Inventors: Harold L. Cook, Jr.; Ernest C. Geer, both of Houston, Tex.; Donald L. Katz, Ann Arbor, Mich.

[73] Assignee: Transco Energy Company, Houston, Tex.

[21] Appl. No.: 807,275

[22] Filed: Jun. 16, 1977

Related U.S. Application Data

[63] Continuation-in-part of Ser. No. 689,621, May 24, 1976, Pat. No. 4,040,487, which is a continuation-in-part of Ser. No. 589,240, Jun. 23, 1975, abandoned.

[51] Int. Cl.[2] ..... E21B 43/00

[52] U.S. Cl. ..... 166/314

[58] Field of Search ..... 166/314, 268, 265, 267, 166/273–275, 263, 245, 252; 175/50

[56] References Cited

U.S. PATENT DOCUMENTS

| | | | |
|---|---|---|---|
| 2,077,912 | 4/1937 | Van Voorhis | 166/265 |
| 3,123,134 | 3/1964 | Kyte et al. | 166/314 X |
| 3,134,434 | 5/1964 | Wooddy, Jr. | 166/263 |
| 3,215,198 | 11/1965 | Willman | 166/263 |
| 3,258,069 | 6/1966 | Hottman | 166/265 X |
| 3,302,581 | 2/1967 | Burch | 166/314 |
| 3,312,278 | 4/1967 | Warden | 166/274 X |
| 3,330,356 | 7/1967 | Hottman | 166/267 X |
| 3,382,933 | 5/1965 | Hottman | 175/50 |
| 3,785,446 | 1/1974 | Fertl et al. | 175/50 |

OTHER PUBLICATIONS

Amyx et al., "Petroleum Reservoir Engineering, Physical Properties," McGraw-Hill Book Co., Inc., N.Y., 1960, pp. 14–16.

Muskat, "Physical Principles of Oil Production," McGraw-Hill Book Co., Inc., N.Y., 1949, pp. 364–369.

Szilas, "Production and Transport of Oil and Gas," Elsevier Scientific Publishing Co., N.Y., 1975, pp. 242, 243, 252–254.

*Primary Examiner*—Stephen J. Novosad

*Attorney, Agent, or Firm*—Fulbright & Jaworski

[57] ABSTRACT

A method of increasing the recovery of natural gas from a geo-pressured aquifer having a structural high or other "trap" from which gas or other fluids cannot escape upward and containing water and gas in solution in the water. The method includes producing water, from one or more wells extending from the surface and completed in the geo-pressured aquifer at a point below and spaced from and remote from the trap, by reservoir pressure at a high enough rate of production to reduce the existing pressure of the aquifer to allow a portion of the gas in solution to be released from the water whereby some of the released gas will migrate upward to form or increase any free-gas phase existing in the trap. Thereafter, gas is produced from one or more wells extending from the surface to the free-gas phase in the trap. Furthermore, the production of water is continued from the one or more wells extending from the surface and completed in said geo-pressured aquifer at a point below and spaced from the trap while producing gas from the trap. In the event that a free-gas phase is dispersed in the water, a portion of the free-gas phase will expand and migrate and some of the expanded gas will migrate more freely to the down structure wells and be produced and some of the expanded free-gas phase will migrate upward to the trap and be produced from the wells completed in the trap.

7 Claims, 6 Drawing Figures

SAND, HAVING WATER FILLED PORES WITH GAS IN SOLUTION IN THE WATER.

GAS SATURATION : 10% OF PORE VOLUME
WATER SATURATION: 90% OF PORE VOLUME

SAND, HAVING A SMALL AMOUNT OF FREE GAS DISPERSED IN BUBBLES WITHIN WATER FILLED PORES

GAS SATURATION : 20% OF PORE VOLUME
WATER SATURATION: 80% OF PORE VOLUME

Fig. 5
SAND, HAVING A CONTINUOUS FREE GAS PHASE WITHIN THE CONNECTED PORES BETWEEN WATER WETTED SAND GRAINS
GAS SATURATION : 40% OF PORE VOLUME
WATER SATURATION: 60% OF PORE VOLUME
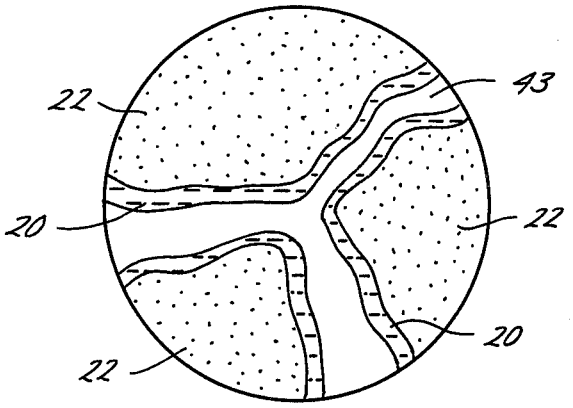
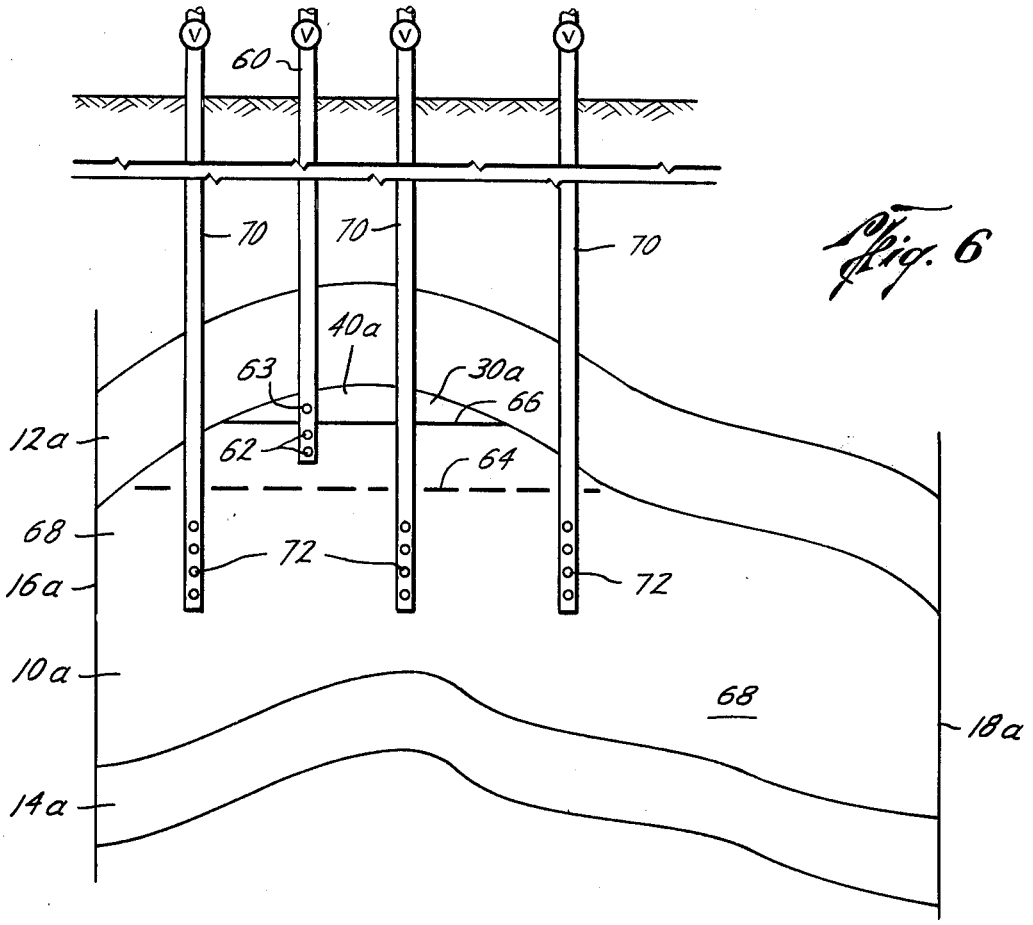
Fig. 6

METHOD FOR INCREASING THE RECOVERY OF NATURAL GAS FROM A GEO-PRESSURED AQUIFER

RELATED APPLICATIONS

This application is a continuation-in-part of copending application Ser. No. 689,621 filed May 24, 1976, now U.S. Pat. No. 4,040,487, which in turn is a continuation-in-part of patent application Ser. No. 589,240 filed June 23, 1975, now abandoned.

BACKGROUND OF THE INVENTION

Geo-pressured aquifers are water reservoirs containing water and natural gas and exist at pressures substantially higher than hydrostatic pressure and when in communication with a well bore will flow water to the surface of the ground in artesian fashion.

Natural gas may be present in geo-pressured aquifers in the form of (1) gas dissolved in the water and also in the form of (2) a free-gas phase dispersed with water within the sand pores. An additional form of natural gas may exist in depleted and non-commercial geo-pressured gas reservoirs where (3) a free-gas phase is present within the sand pores above and separate from the water.

Our prior application Ser. No. 689,621, now U.S. Pat. No. 4,040,487, was directed to producing water from wells completed in geo-pressured aquifers so as to maximize the recovery of natural gas by producing water from an aquifer under aquifer pressure so as to lower the pressure in the aquifer sufficiently to allow a portion of the gas to be released from solution whereby the released gas would migrate more freely than the water to the well and be produced and the gas recovered at the surface. However, the gas released from the water in such a method may flow, not to the producing wells, but to a trap in the aquifer to form a free-gas phase in the trap or to enlarge a previously formed free-gas phase existing in the trap.

The present invention is directed to a method of maximizing gas yield from geo-pressured aquifers by producing additional gas trapped in the trap which also has the advantage of further reducing the pressure in the aquifer and thereby releasing additional gas for production.

SUMMARY

The present invention is directed to a method of increasing the recovery of natural gas from a geo-pressured aquifer having a trap in the aquifer and containing water and gas in solution in the water by producing water, from one or more wells extending from the surface and completed in the geo-pressured aquifer at a point below and spaced from and remote enough from the trap to generate a pressure drop across a large area in the aquifer, by aquifer pressure at a high enough rate of production to reduce the pressure of at least a portion of the aquifer. This allows some of the gas in solution to be released from the water whereby a portion of the released gas will be produced from the well and a portion of the released gas will migrate upward to form or enlarge a free-gas cap in the trap. Thereafter, gas is produced from one or more wells extending from the surface to the free-gas cap.

A still further object of the present invention is to obtain increased enhanced gas recovery by continuing producing water from the one or more wells extending from the surface and completed in the geo-pressured aquifer at a point below and spaced from the trap while producing gas from the one or more wells extending from the surface and completed in the free-gas cap.

A further object of the present invention is, in the event that the aquifer also contains a zone of free gas dispersed in the water, of first producing water, from one or more wells extending from the surface and completed in the water and spaced from the trap for enhancing the gas recovery by allowing the free gas dispersed in the water to expand and become mobile, whereby some of the expanded gas will migrate more freely to the well and be produced and some of the mobile gas will migrate to a position in the trap to form or enhance any free-gas phase in the trap.

Yet a further object of the present invention is to, after producing water from the aquifer, produce gas from the gas cap which not only recovers additional gas, but further reduces the pressure over a large area of the aquifer which induces additional gas to be released from the water in the aquifer.

Still a further object of the present method, after the water ceases to flow under its own pressure, is to produce water and gas by using additional gas to lift the water for further lowering the aquifer pressure and releasing still further gas.

Other and further objects, features and advantages will be readily apparent from the following description of a preferred embodiment.

DESCRIPTION OF THE DRAWINGS

FIG. 5 is an enlarged cross-sectional view of a portion of a geo-pressured aquifer having a free-gas phase separate from the water (form 3), and FIG. 6 is a diagrammatic cross-sectional view of a watered-out gas reservoir containing gas in all three forms.

DESCRIPTION OF THE PREFERRED EMBODIMENT

Figure 1:
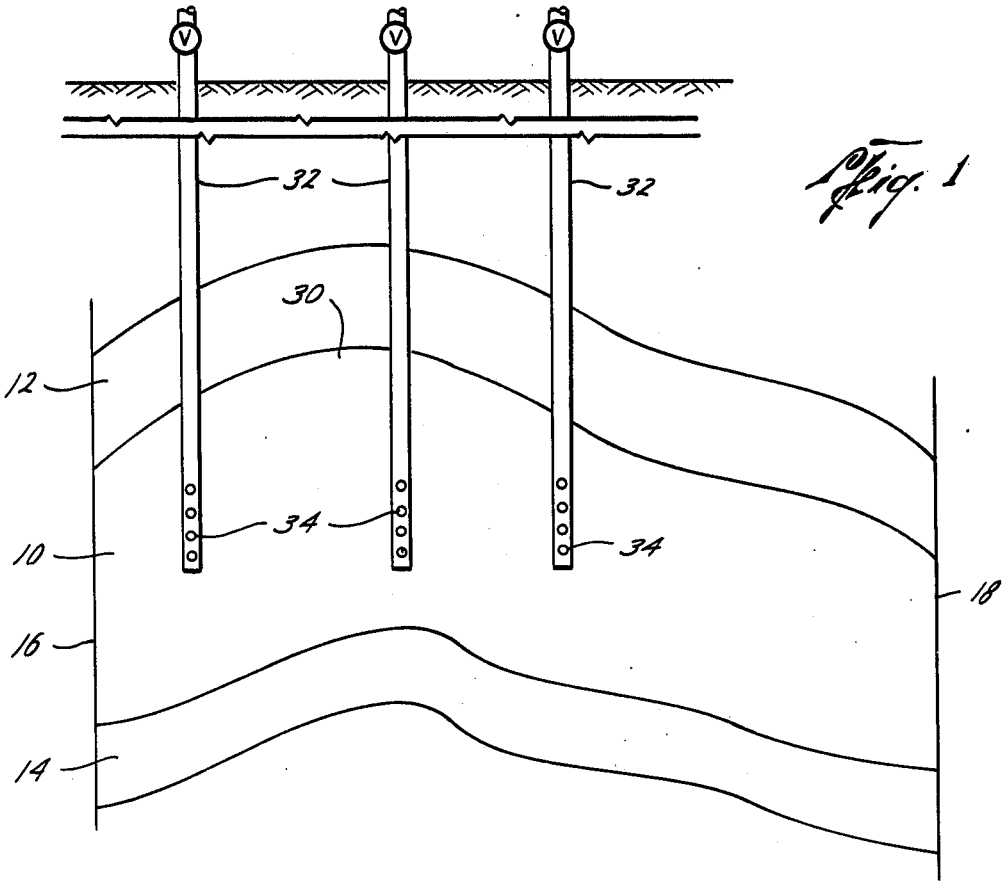
FIG. 1 is a diagrammatic cross-sectional view of a geo-pressured aquifer having only natural gas dissolved in the water in the sand pores (form 1)
Figure 3:
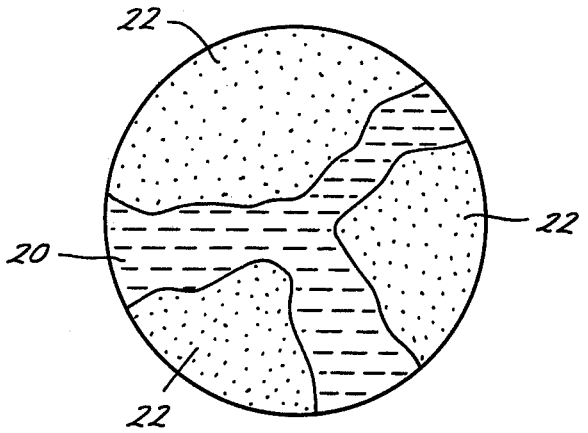
FIG. 3 is an enlarged cross-sectional view of a portion of the geo-pressured aquifer in which natural gas is dissolved in the water in the sand pores (form 1)

Referring now to FIG. 1, a geo-pressured reservoir 10 is shown having an upper impervious formation 12, and a lower impervious formation 14 containing the aquifer 10 therebetween. Faults 16 and 18 exist on opposite sides of the aquifer 10. The formations 12 and 14 and faults including 16 and 18 prevent the escape of gas and water therefrom. The aquifer 10 is of the type in which the natural gas, primarily methane, as shown in FIG. 3, is dissolved in the water 20 in the sand pores 22 (form 1). The water 20 containing dissolved natural gas completely fills the pores between the sand particles 22.

Our prior patent application, Ser. No. 689,621, now U.S. Pat. No. 4,040,487, was directed to producing water from a geo-pressured aquifer at a high rate of flow, for example an initial flow rate of at least 15,000 barrels of water per day per well in order to reduce the pressure of at least a portion of the aquifer, such as by at least 25%, so that the solution gas (form 1) will become liberated from the water and will become mobile, free to flow to the producing well independent of the water flow and be recovered. That is, our prior application provided for the recovery of solution gas from water not produced.

Referring to FIG. 1, it is to be noted that the top impervious formation 12 includes a trap 30 overlaying a portion of the aquifer 10. The trap 30 is a structural high under the formation 12 or is any barrier which prevents vertical migration of gas and causes accumulation of gas thereunder. The present invention is directed to producing water from the aquifer 10 through one or more wells 32 which extend from the ground surface and are completed in the geo-pressured aquifer 10 at points 34 below and spaced from the trap 30. Preferably, the completion points 34 are remote enough from the trap 30 to generate a pressure drop across a large area of the aquifer 10 beneath the trap 30. The wells 32 are produced by reservoir pressure at a high enough rate of production to reduce the existing bottom hole pressure of the wells 32 to allow a portion of the gas in solution in the aquifer 10 to be released from the water. For example, the initial flow rate from each of the wells 34 produced should be at least 25,000 barrels of water per day and the pressure of a portion of the aquifer should be reduced by at least 25%.

Figure 2:
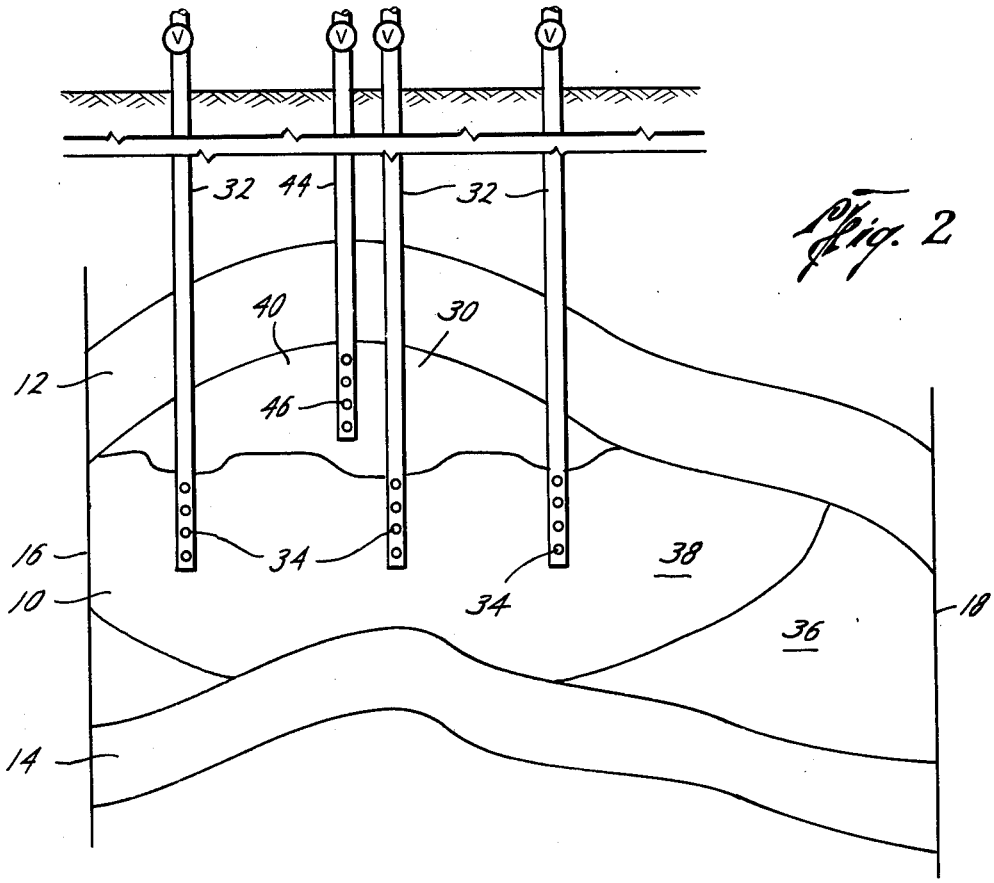
FIG. 2 is a diagrammatic cross-sectional view of the aquifer of FIG. 1 subsequent to producing water therefrom so as to lower the pressure in the aquifer sufficiently to allow some of the gas to be released from the water.
Figure 4:
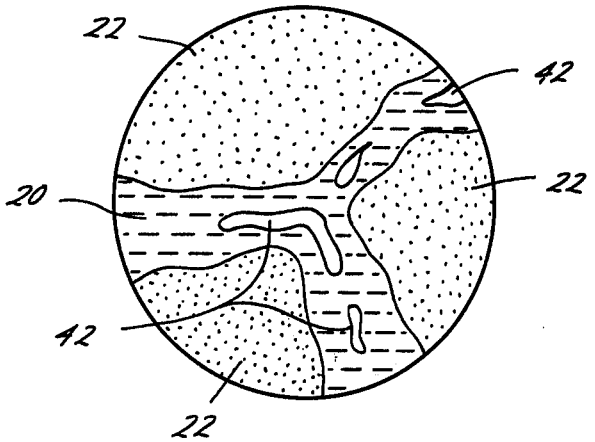
FIG. 4 is an enlarged cross-sectional view of a portion of a geo-pressured aquifer having a dispersed free gas (form 2) such as found in watered-out gas reservoirs or non-commercial gas reservoirs as well as gas dissolved in the water (form 1)

Referring now to FIG. 2, a cross section of the aquifer 10 of FIG. 1 is shown subsequent to producing water from the wells 32 for a period of time, such as one year, for reducing a portion of the aquifer pressure by at least 25%. The characteristics of the aquifer 10 are now changed. The aquifer 10 now includes a zone 36 of natural gas dissolved in the water (form 1) of the type shown in FIG. 3, a zone 38 of a free-gas phase dispersed with water (form 2) as best seen in FIG. 4, and a zone 40 of a free-gas phase separate from water (form 3) as best seen in FIG. 5. The free-gas phase zone 40 accumulates under the trap 30 as pressure is reduced in the aquifer 10, gas is released from solution in the water and migrates upward. Zone 38, as illustrated in FIG. 4, has the sand grains 22 surrounded by water 20 having gas in solution (form 1), but additionally has a free-gas phase 42 dispersed in bubbles in the water 20. The zone 40 which has a free-gas phase present separate from the water (form 3) is illustrated in FIG. 5 and the sand grains 22 are surrounded by water 20 with gas in solution (form 1), but also has free gas 43 dispersed in bubbles and separate from the water 20. The exact boundaries and compositions of the various zones 40, 38 and 36, as shown schematically in FIGS. 1–5, will depend upon the physical properties of the aquifer 10. The present invention includes, after production of water from the wells 32 as previously indicated, the step of producing gas from the free-gas zone 40 through openings 46 in one or more wells 44 extending from the surface and completed in the free-gas zone 40 in the trap 30. Well 44 will maximize gas production by producing the free gas along with some water in the zone 40 and will reduce the total pressure in the aquifer 10 to a lower level. This is because the production from the zone 40 covers a large aerial extent and affects a larger aerial extent of the aquifer 10 than the wells 32 due to the better flow characteristics for gas alone than that which occurs when water and gas from either zones 36 or 38 flow through the aquifer 10. The lower average reservoir pressure of the aquifer 10 obtainable by producing from both wells 32 and 34 results in more gas being ultimately produced.

The present invention is also useful in a reservoir containing a free-gas zone, such as a watered out natural gas reservoir or a reservoir which is considered marginal or non-commercial in a conventional gas production mode. Referring now to FIG. 6, such a reservoir is shown wherein like parts to those indicated for the aquifer 10 of FIGS. 1 and 2 are similarly numbered with the suffix "*a*". Aquifer **10*a* is a cross-sectional view of a natural gas reservoir, the well(s) 60 of which have been invaded by water. The aquifer 10*a* is shown as including a gas zone 40*a* in the trap 30*a* containing an unrecovered gas phase (form 3) as illustrated in FIG. 5 in which the well(s) 60 produce excessive water by conventional production methods. That is, the original gas/water interface 64 was below the openings 62 in the well(s) 60 and allowed conventional recovery of gas from the zone 40*a*. However, with water encroachment, the gas/water interface rose to 66 and natural gas production through well(s) 60 ceased due to the water incursion. There will have been some pressure drop in the aquifer 10*a* during the conventional natural gas production and the pressure drop will depend on the relative size of the gas zone 40*a* to the aquifer 10*a*. The zone 68 below the gas zone 40*a* will be a mixture of free gas (form 3) as shown in FIG. 5, free gas dispersed in the water (form 2) as shown in FIG. 4, and some gas in solution in the water (form 1) as shown in FIG. 3. Under the present method, water would be produced from the wells 70 through openings 72 at a high rate of production to reduce the aquifer pressure so that the natural gas in the water will be released from the water and a portion will migrate more freely than the water to the wells 70 and be recovered. In addition, a portion of the released gas will migrate upwardly and enlarge the free-gas phase in zone 40*a* in trap 30*a***.

It is to be noted that wells 70 are completed in the aquifer **10*a* at a point below and spaced from the trap 30*a* whereby water from the reservoir 10*a* is produced, but gas from the zone 40*a* is not produced by the wells 70. The purpose of producing water from the wells 70 is to reduce the pressure in the aquifer 10*a* and release gas from the water in zone 68 and allow the released gas to migrate vertically upward and allow the gas-phase zone 40*a* to expand. The gas/water interface 66** will then move downward.

Later, the free gas in the trap **30*a* is then produced through well(s) 60 either through openings 62 or additional openings 63. Removal of free gas from zone 40*a* not only recovers the gas which has accumulated and/or existed in the gas trap 30*a*, but further reduces the pressure over a large area of the aquifer 10*a* which induces additional gas to be released from the zone 68**.

Additionally, it is contemplated to further reduce the pressure in aquifer **10*a* by continuing producing water from one or more of the wells 70 while simultaneously producing gas through well(s) 60 completed in the trap 30*a* as the recovery of gas will be maximized by lowering the reservoir pressure thereby allowing gas in the zone 68 to be released from the water and migrate either to the wells 70 or 60**.

Furthermore, the present method also includes the step of further removing water from the wells 32 (FIGS. 1 and 2) and wells 70 (FIG. 6) after these wells have ceased flowing water under the aquifer pressure in order to further lower the pressure in the aquifers 10 and 10*a*, respectively, thereby releasing more gas from the water. One suitable method for removing additional water is by means of an artificial lifting method such as conventional gas lift using the gas obtained from the gas caps 40 and 40*a* and injecting the gas in the annulus between the casing and tubing of wells 32 and 70, respectively, and into the tubing to lift additional water through the well tubing.

The present invention, therefore, is well adapted to carry out the objects and attain the ends and advantages mentioned as well as others inherent therein. While a presently preferred embodiment of the invention is given for the purpose of disclosure, numerous changes in the steps of the process depending upon aquifer conditions encountered will readily suggest themselves to those skilled in the art and which are encompassed within the spirit of the invention and the scope of the appended claims.

What is claimed is:

1. A method of increasing the recovery of natural gas from a geo-pressured aquifer having a trap in the aquifer and containing water and gas in solution in the water comprising, producing water, from one or more wells extending from the surface and completed in said geo-pressured aquifer at a point below and spaced from the trap, by reservoir pressure at a high enough rate of production to reduce the pressure of a portion of the aquifer to allow a portion of the gas in solution to be released from the water whereby some of the released gas will migrate upwardly to form a free-gas phase in the trap and a portion of released gas will be produced from said one or more wells, and thereafter producing gas from one or more wells extending from the surface to the free-gas phase in the trap.

2. The method of claim 1 including, continuing producing water from the one or more wells extending from the surface and completed in said geo-pressured aquifer at a point below and spaced from the trap while producing gas from the one or more wells extending from the surface to the free-gas phase in the trap.

3. The method of claim 2 including, after water production, from the one or more wells completed in said geo-pressured aquifer at a point below and spaced from the trap, substantially ceases due to a reduction in reservoir pressure, producing additional water by artificially lifting water from said one or more wells completed in said geo-pressured aquifer at a point below and spaced from the trap.

4. A method of increasing the recovery of natural gas from a geo-pressured aquifer having a trap in the aquifer and containing water and gas in solution in the water and a zone of free gas dispersed in water comprising, producing water and natural gas under aquifer pressure from one or more wells extending from the surface and completed in the geo-pressured aquifer at a point below and remote and spaced from the trap, so as to lower the pressure in the aquifer sufficiently to allow a portion of the free gas dispersed in the water and a portion of the gas in solution to be released from the water whereby some of the released natural gas will migrate more freely to the well and be produced and some of the released gas will migrate to the trap to form a free-gas phase, and thereafter producing gas from the free-gas phase by one or more wells extending from the surface and completed in the free gas phase.

5. The method of claim 4 including, continuing producing water from the one or more wells extending from the surface and completed in said geo-pressured aquifer at a point below and remote and spaced from the trap while producing gas from the one or more wells extending from the surface to the free-gas phase.

6. The method of claim 5 including, after water production, from the one or more wells completed in said geo-pressured aquifer at a point below and spaced from the trap, substantially ceases due to a reduction in reservoir pressure, producing additional water by artificially lifting water from said one or more wells completed in said geo-pressured aquifer at a point below and spaced from the trap.

7. A method of increasing the recovery of natural gas from a geo-pressured natural gas reservoir having a trap in the aquifer and containing water and gas in solution in the water, a zone of free gas dispersed in the water and a free-gas phase positioned in the trap comprising, producing water, from one or more wells extending from the surface and completed in said geo-pressured aquifer at a point below the free-gas phase, by reservoir pressure at a high enough rate of production to reduce the existing reservoir pressure to allow a portion of the free gas dispersed in the water to migrate and a portion of the gas in solution to be released from the water whereby more than one form of natural gas from the reservoir is recovered from the wells and some of the released gas will migrate to and increase said free-gas phase, and thereafter producing gas from one or more wells extending from the surface to the free-gas phase.

* * * * *